US005117215A

United States Patent [19]

Kakehashi et al.

[11] Patent Number: 5,117,215

[45] Date of Patent: May 26, 1992

[54] INDUCTIVE DEVICE

[75] Inventors: Hidenori Kakehashi, Hirakata; Tomio Oori, Toyonaka, both of Japan

[73] Assignee: Matsushita Electric Works, Ltd., Osaka, Japan

[21] Appl. No.: 598,319

[22] Filed: Oct. 16, 1990

[30] Foreign Application Priority Data

Oct. 18, 1989 [JP] Japan ..... 1-272257

[51] Int. Cl.[5] ..... H01F 17/06; H01F 27/30

[52] U.S. Cl. ..... 336/178; 336/192; 336/198; 336/212

[58] Field of Search ..... 336/178, 212, 198, 208, 336/192, 83

[56] References Cited

U.S. PATENT DOCUMENTS

| | | | |
|---|---|---|---|
| 1,598,486 | 8/1926 | Mallory | 336/178 |
| 4,047,138 | 9/1977 | Steigerwald | 336/178 |
| 4,238,753 | 12/1980 | Bayer | 336/178 X |
| 4,240,057 | 12/1980 | Decher et al. | 336/178 X |
| 4,334,206 | 6/1982 | Nakamura | 336/178 |
| 4,424,504 | 1/1984 | Mitsui et al. | 336/83 |
| 4,587,506 | 5/1986 | Hoeksma | 336/178 |
| 4,737,755 | 4/1988 | Hopmans | 336/178 |

FOREIGN PATENT DOCUMENTS

| | | |
|---|---|---|
| 3031802 | 3/1981 | Fed. Rep. of Germany . |
| 8616484.8 | 9/1986 | Fed. Rep. of Germany . |
| 53-30992 | 8/1978 | Japan . |

*Primary Examiner*—Thomas J. Kozma
*Attorney, Agent, or Firm*—Armstrong, Nikaido, Marmelstein, Kubovcik & Murray

[57] ABSTRACT

An improved inductive device has a U-shaped ferrite magnetic core with a base and a pair of parallel legs integrally extending from the opposite ends of the base. A straight ferrite magnetic core is disposed between the opposed core legs to define airgaps respectively between the ends of said straight core and the legs. A winding is disposed to surround the straight core. Each of the core legs is formed to have a generally flush surface over substantially the entire length thereof such that the portion of the flush surface is cooperative with the end of the straight core to define the airgap.

11 Claims, 5 Drawing Sheets

INDUCTIVE DEVICE

BACKGROUND OF THE INVENTION

1. Field of the Invention

The present invention is directed to an inductive device, and more particularly to an inductive device having a generally U-shaped core and a straight core defining therebetween a pair of airgaps.

2. Description of the Prior Art

Inductive devices such as inductors and transformers are widely utilized in switching regulators and inverter circuits. For such inductive devices, a ferrite magnetic core with an airgap or airgaps is preferred in order to facilitate inductance adjustment or minimize variations in the inductance, as well as to improve thermal stability as well as DC drooping, i.e., to prevent saturation of the core. As the ferrite cores with the airgaps, there have been proposed in the art an EI-shaped core arrangement with E-shaped and I-shaped core elements, an EE-shaped core arrangement with a pair of opposed E-shaped core elements, or pot-type core arrangement with a barrel core element of E-shaped cross-section. In either of the above types of cores, the core elements are opposed to define therebetween more than one airgap which may cause an external leakage flux. Such external leakage flux will penetrate through adjacent parts such as a casing, capacitors, radiators of semiconductors, and other inductors or transformers to thereby induce heating and noise in an electric appliance or even to considerably alter their electric characteristic and to lower the electrical efficiency thereof.

In order to avoid the above problems, there has been also proposed in the art another core of a modified EE-type in which, as shown in FIG. 13, a pair of E-shaped core halves 1 are combined to form only one airgap 2 between the center legs and a winding 3 is disposed around the center legs to surround the airgap 2. However, with such airgap arrangement, fringing flux appears, as indicated by arrows 4 in the figure, to extend outwardly of the airgap 2 in such a manner as to cross or cut the winding 3 to constitute flux linkage, thereby increasing eddy current losses in the winding 3 and therefore causing excess heating of the winding 3. This is particularly critical in the power inductors for use in switching regulators or inverters operating at a high frequency above 20 kHz to carry a relatively large current.

Also from the viewpoint of obtaining characteristic stability and compact arrangement, the above modified EE-shaped core arrangement having only one airgap between the center legs is found unsatisfactory for the reason that it might incur much inductance variations or larger sizes than the EE-shaped core arrangement where the airgaps are each formed between the outer core legs, and therefore impose a certain limitation on the design of the inductor or the transformers. This is known from the following equation:

$$L \approx \mu_0 \frac{S_g}{l_g} N^2$$

where L is the inductance, $\mu_o$ is the permeability of air in vacuum, $S_g$ is the equivalent cross-sectional area of the magnetic circuit at the gap, $l_g$ is the length of the gap, and N is the number of turns in the winding. In the magnetic circuit of the EE-type core, magnetic flux extends outwardly of the gaps each formed between the outer core legs to give $S_g$ which is greater than for the above modified EE-shaped core. That is, to obtain the same inductance, the above modified EE-shaped core arrangement must have less $l_g$ than that for the EE-shaped core, and is therefore more susceptible to the influence of dimensional variation, which in turn results in critical variation in the inductance. Alternatively, when N is increased to have the same effect without reducing $l_g$, the winding becomes more bulky and fails to meet the compact-size requirement, in addition to that the winding suffers from the correspondingly increased electrical resistance or heating. It is therefore highly demanded for the inductive device to have:

(1) less external leakage flux so as to minimize the influence upon the adjacent parts for reducing noises and improving efficiency;

(2) less winding resistance so as to minimize the amount of the heat dissipated from the winding; and (3) less susceptible to dimensional variations so as to assure consistent electric inductance and property.

To satisfy the above requirements, it may be effective to present a unique core configuration comprising a U-shaped core and a straight core which is disposed between the opposed legs of the U-shaped core to define airgaps at the respective ends of the straight core. With this core configuration and a winding disposed around the straight core, it is readily possible to greatly reduce the external leakage flux emanating from the ends of the straight core. Also, with this core configuration, the air gap is allowed to be spaced away from the winding such that it seos no substantial flux linkage to thereby reduce the amount of heating at the winding.

The like core configuration is seen in Japanese Utility Model Publication (KOKOKU) No. 53-30992, although the publication does not teach to reduce the fringing flux or to improve electromagnetic characteristics, but to disclose a useful layout for supporting the windings to the core by adhesives. As schematically shown in FIG. 14, the core of the Japanese publication includes a U-shaped core 10 with a pair of opposed legs 12 each having an inward projection 13 at its free end. A straight core 15 is disposed between the inward projections 13 in alignment therewith to define a pair of airgaps 16 between the straight core 15 and the inward projections 13. Each of the airgaps 16 is surrounded by each one of windings 18. Although this core configuration is effective to reduce the external leakage flux, it still suffers from the flux linkage at each of the airgaps, which eventually results in the undesired heating at the winding. Also, due to the presence of the inward projection 13, the U-shaped core 10 sees, in addition to two flux converging points $P_1$ at the inner ends of the legs 12, two more flux converging points $P_2$ at the corners between the projections 13 and the legs 12. Since the flux converging is disadvantageous when reducing magnetic saturation, losses, heating of the winding, the number of the flux converging points should be kept at a minimum. In this respect, the above Japanese publication is found insufficient and unsatisfactory. Further, at the assembly of fixing the straight core 15 to the U-shaped core 10, it is often required to adjust the relative position of the straight core 15 to the U-shaped core 10 in order to compensate for dimensional variations thereof and to give a desired inductance. The adjustment can be made by shifting the straight core 15 along the length of the core legs 12 to vary the magnetic resistance. However, with the core configuration of FIG. 14, the shifting of the straight core 15 from the aligned position with the inward projections 13 would cause an abrupt change in the gap distance, thereby causing an correspondingly abrupt change in the inductance, as indicated by dotted line in FIG. 15, therefore failing to assure precise inductance adjustment at the assembly of the core.

SUMMARY OF THE INVENTION

The above problems and insufficiencies are all eliminated in the present invention which provides an improved inductive device for inductors or transformers. The inductive device of the present invention comprises a generally U-shaped ferrite magnetic core with a base and a pair of opposed legs integrally extending from the opposite ends of the base, and a straight ferrite magnetic core disposed between the ends of the core legs to define airgaps each between the core leg and the straight core. A winding is disposed to surround the straight core. The core legs are formed along their opposed inner sides respectively with generally flush surfaces extending in parallel relation with each other. It is this flush surface that is cooperative with the adjacent end of the straight core to define therebetween the airgap. With this core configuration of confining the straight core between the core legs, an external leakage flux from the airgaps can be reduced to a minimum. Also by the provision of the winding around the straight core, there is less chance that the fringing flux at the airgap will pass through the winding, which is effective to keep the flux linkage at a minimum and therefore to reduce the amount of heat generated at the winding. Further, by the provision of the parallel flush surfaces along the core legs, it is readily possible to shift the straight leg along the length of the core legs so as to vary the magnetic loop length, i.e., the magnetic resistance of the loop without changing the gap distance. That is, the inductance can be adjusted solely by changing the magnetic resistance of the core without consideration of the gap distance such that the inductance can be adjusted precisely in compensation for dimensional variations of the core.

Accordingly, it is a primary object of the present invention to provide an improved inductive device for use as inductors or transformers which is capable of reducing the external leakage flux and coil losses, and assuring consistent magnetic properties.

In a preferred embodiment, a coil bobbin of electrically insulative material is provided to carry the winding and at the same time to carry the U-shaped core and the straight core in a predetermined spatial relation for exactly positioning the cores and the winding. To this end, the coil bobbin is formed with a bore into which the straight core is inserted and also with a pair of slots in which the opposed core legs of the U-shaped core are fitted. An integral tab is formed in the bore to support one end of the straight core and to space that end from the adjacent core leg in the slot by the distance of the airgap. The straight core is adhered at its one end to the tab by an adhesive with the other end kept within the bore. The U-shaped core is assembled to the coil bobbin by guiding the core legs along the slots and is secured thereto with one of the core legs adhered to the bottom of the slot in close contact thereto while keeping the other core leg spaced away from the bottom of the corresponding slot to make a clearance between the non-adhered core leg and the adjacent coil bobbin. This is particularly advantageous for protecting the U-shaped core from being cracked or fractured when subjected to an elevated temperature environment where the coil bobbin normally made of plastic material exhibit greater coefficient of expansion than the ferrite core. That is, the clearance left between the non-adhered core leg and the bottom of the slot can act to absorb expansion of the coil bobbin such that the coil bobbin will not give deformative force to the U-shaped core, whereby preventing the crack or fracture of the U-shaped core.

It is therefore another object of the present invention to provide an improved inductive device in which the U-shaped core and the straight core can be supported in a predetermined relation by better utilization of the coil bobbin carrying the winding, yet keeping the U-shaped core harmless from the expansion of the coil bobbin.

These and still other object and advantageous features of the present invention will become more apparent from the following description of the preferred embodiment when taken in conjunction with the attached drawings.

DETAILED DESCRIPTION OF THE PREFERRED EMBODIMENT

Figure 1:
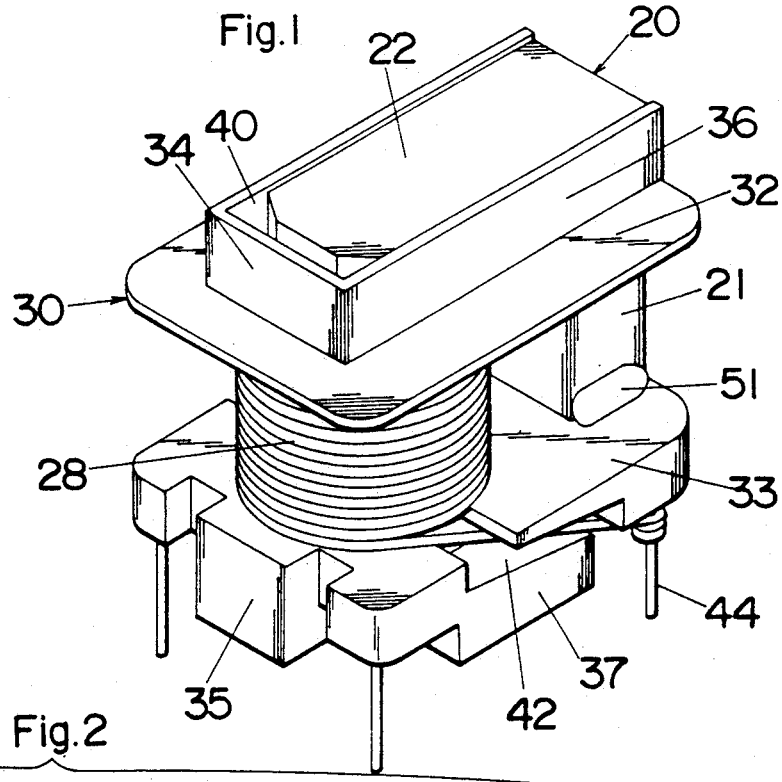
FIG. 1 is a perspective view of an inductor device in accordance with a preferred embodiment of the present invention.
Figure 2:
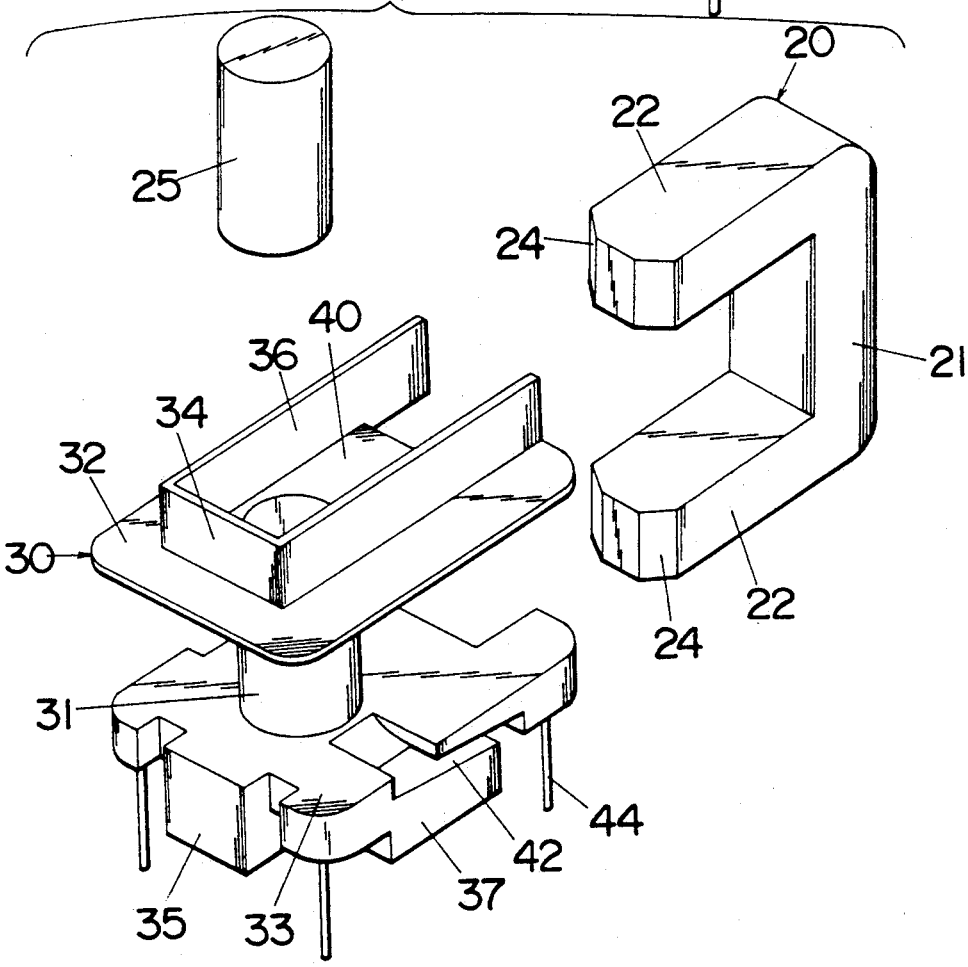
FIG. 2 is an exploded perspective view of the inductor device.
Figure 3:
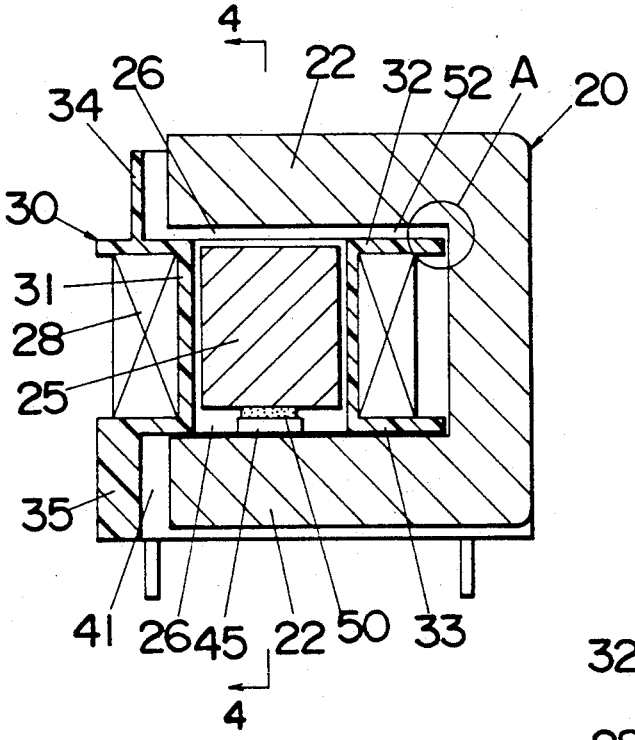
FIG. 3 is a vertical section of the inductor device.

Referring now to FIGS. 1 to 3, an improved inductive device in accordance with a preferred embodiment of the present invention is shown to comprise a U-shaped ferrite magnetic core member 20 with a base 21 and a pair of parallel legs 22 extending from the opposite end of the base 21. A straight ferrite magnetic core member 25 of cylindrical configuration is disposed between the free ends of the legs 22 to define airgaps 26 between the ends of the straight core 25 and the opposed legs 22. These core members are sintered products from ferrite powder. A winding 28 surrounding the straight core 25 is held on a coil bobbin 30 of electrically insulative plastic material such as phenols. The coil bobbin 30 is configured to hold the core members 20 and 25 together in a predetermined relation. For this purpose, the coil bobbin 30 is formed to have a barrel 31 around which the winding 28 is disposed and into which the straight core member 25 is inserted. Integrally formed at the ends of the barrel 31 are upper and lower flanges 32 and 33 between which the winding 28 is received. Each of the flanges 32 and 33 integrally includes an end wall 34,35 and a pair of side walls 36,37 which are cooperative with each other to form a slot 40,41 for receiving each one of the legs 22 of the U-shaped core 20, as shown in FIG. 3. Thus formed slots 40,41 have bottom walls defined respectively by the upper and lower flanges 32 and 33 and open into a bore of the barrel 31. The side walls 37 of the lower flange 33 are made relatively thick and are provided with a set of downwardly extending terminal pins 44 and also with grooves 42 through which the ends of the windings 28 are routed to the corresponding terminal pins 44.

Figure 4:
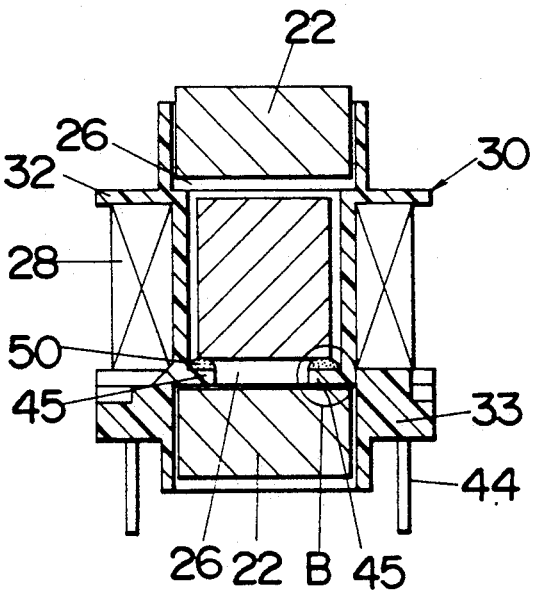
FIG. 4 is a sectional view taken along line 4—4 of FIG. 3.
Figure 5:
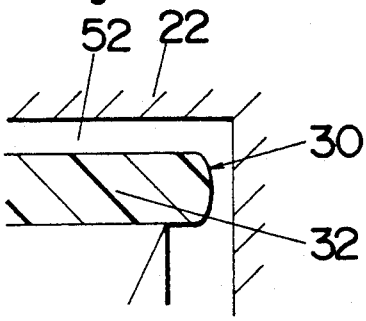
FIG. 5 is an enlarged view of a portion A in the inductor device of FIG. 3.
Figure 6:
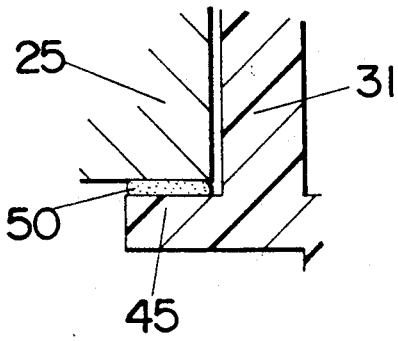
FIG. 6 is an enlarged view of a portion B in the inductor device of FIG. 4.
Figure 7:
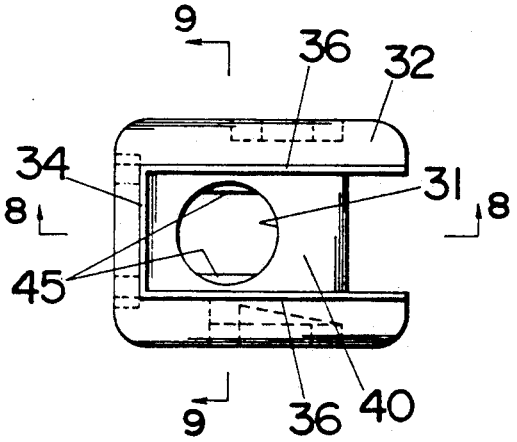
FIG. 7 is a top view of a coil bobbin of the inductor device.
Figure 8:
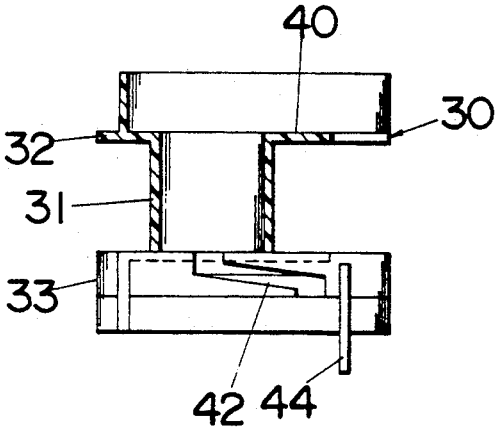
FIG. 8 is a sectional view taken along line 8—8 of FIG. 7.
Figure 9:
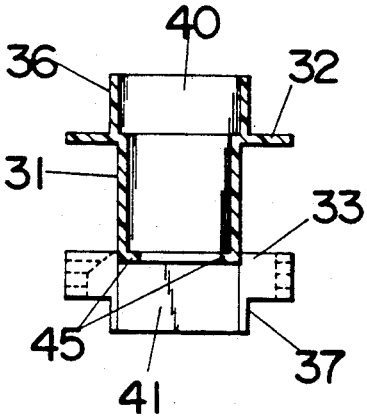
FIG. 9 is a sectional view taken along line 9—9 of FIG. 7.
Figure 10:
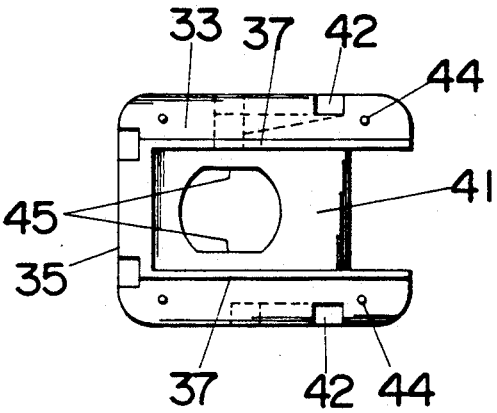
FIG. 10 is a bottom view of the coil bobbin.

As shown in FIGS. 4, 7, and 9, a pair of tab segments 45 are formed in the coil bobbin 30 to project into the lower end of the barrel 31 for supporting thereon the straight core member 25 such that the lower end of the core member 25 can be spaced from the adjacent core leg 22 to define therebetween the airgap 26. An epoxy resin adhesive 50 is utilized to fix the straight core 25 into the barrel 31. After the core legs 22 are guided into the slots 40 and 41, the U-shaped core 20 is moved slightly upwardly relative to the coil bobbin 30 so that the lower core leg 22 is pressed against the bottom of the lower slot 41, at which condition the core 20 is secured to the coil bobbin 30 at the juncture between the base 21 and the lower flange 33 by the like adhesive 51 (FIG. 1), while leaving the other core leg 22 spaced above the upper flange 32 to make a clearance 52 therebetween, as shown in FIGS. 3 and 5. Such clearance 52 can well absorb an expansion difference between the plastic coil bobbin 30 and the ferrite core 20 which may occur when the assembly is exposed to an elevated temperature, thereby preventing the U-shaped core 20 from being cracked or fractured by the expanding coil bobbin 30. The clearance 52 may be fitted with an elastic material or adhesive such as silicon, flexibilized epoxy resin (sold under the tradename EP-170 of from Cemedine K.K. Japan) or the like which exhibits large flexibility capable of absorbing the above expansion difference.

In the case when the winding is held directly on the straight core without the use of the coil bobbin, it is possible to fix the one end of the straight core to one of the core legs by the like adhesive with a suitable airgap defining spacer therebetween, while leaving the other end of the straight core spaced from the other core leg with or without a like elastic material interposed therebetween. This is also effective to protect the U-shaped core from being damaged by the expansion and shrinkage of the adhesive.

The airgaps 26 at the ends of the straight core 25 are each fitted with an elastic adhesive such as flexibilized epoxy resin adhesive [EP-170 from Cemedine K.K., Japan] disclosed hereinbefore in order to establish exact positioning of the cores as well as to absorb a potential expansion difference between the core 20 and the coil bobbin 30.

Figure 12:
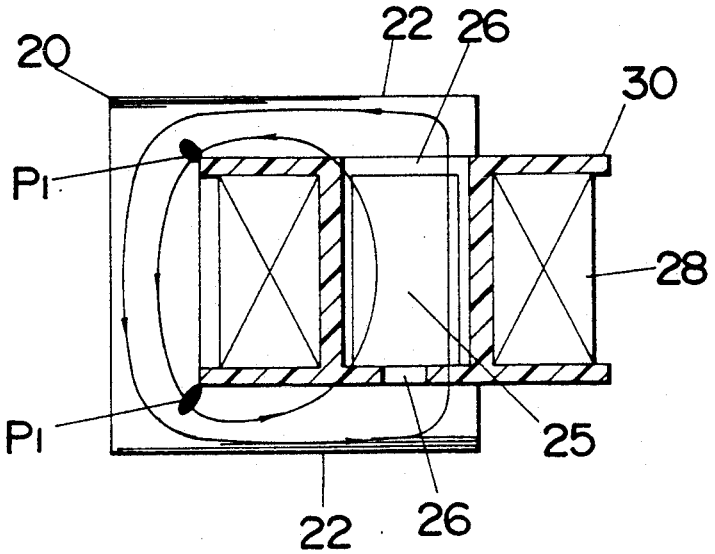
FIG. 12 is a schematic view of the inductor device.
Figure 13:
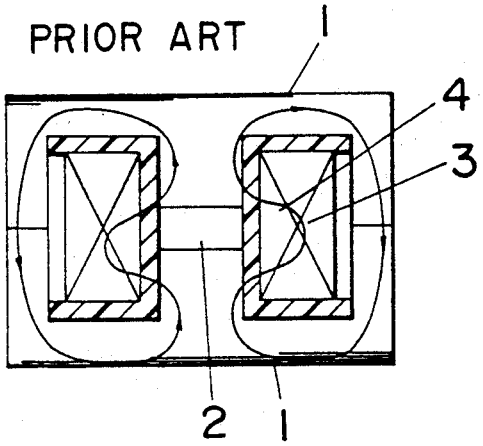
Fig.13 PRIOR ART
FIG. 13 is a schematic view of a prior art inductor device.
Figure 14:
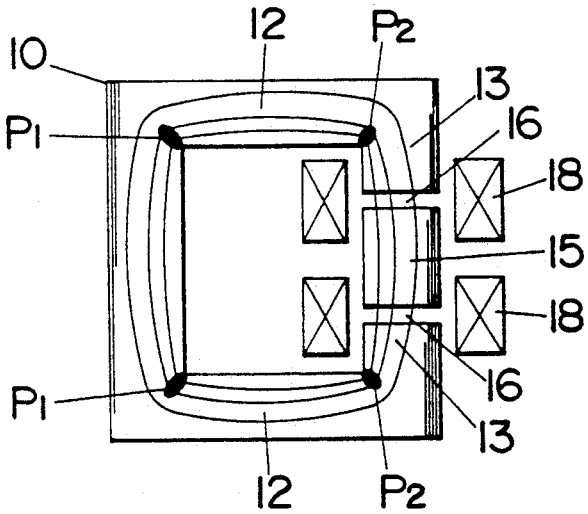
Fig.14 PRIOR ART
FIG. 14 is a schematic view of another prior art inductor device.
Figure 15:
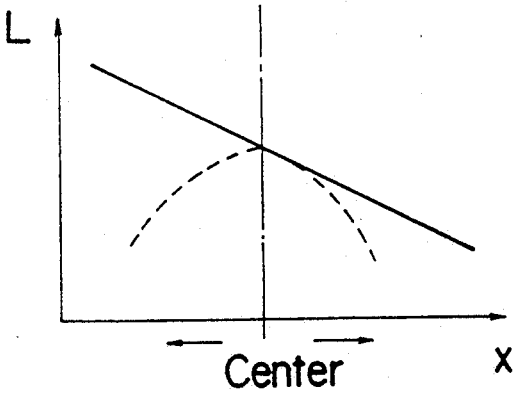
FIG. 15 is a chart illustrating the relation between the inductance of the inductive device and the shifting amount of a straight core relative to a U-shaped core.

The core legs 22 of the U-shaped core 20 are finished to provide parallel flush inside surfaces over substantially the entire length thereof. Likewise the end faces of the straight core 25 are finished to provide flush surfaces in parallel relation with the corresponding inside surfaces of the core legs 22. Therefore, when it is required to adjust the inductance, the straight core 25 can be shifted in its position along the length of the core legs 22 in order to vary the magnetic loop length or the loop resistance without varying the gap distance itself, making it possible to precisely adjust the inductance as indicated by solid lines in FIG. 15. In the opposite sense, there is a relatively large tolerance in positioning of the straight core 25 relative to the U-shaped core 20 without causing substantial variation in the inductance, which is advantageous for assembly of the inductive device. It is also noted at this time that the winding 28 can extend over substantially the full length of the straight core 25 while eliminating the flux linkage at the airgaps, which contributes to retain the bulk of the winding at a minimum and therefore assure compact design of the inductive device. Further, since the core legs 22 have no projection at the portion defining the airgap, the magnetic circuit sees flux converging points Pl substantially only at the juncture between the base 21 and the core legs 22 and not at the portion adjacent the straight core 25, as schematically shown in FIG. 12, which is advantageous in reducing magnetic saturation, losses, heating of the winding.

Figure 11:
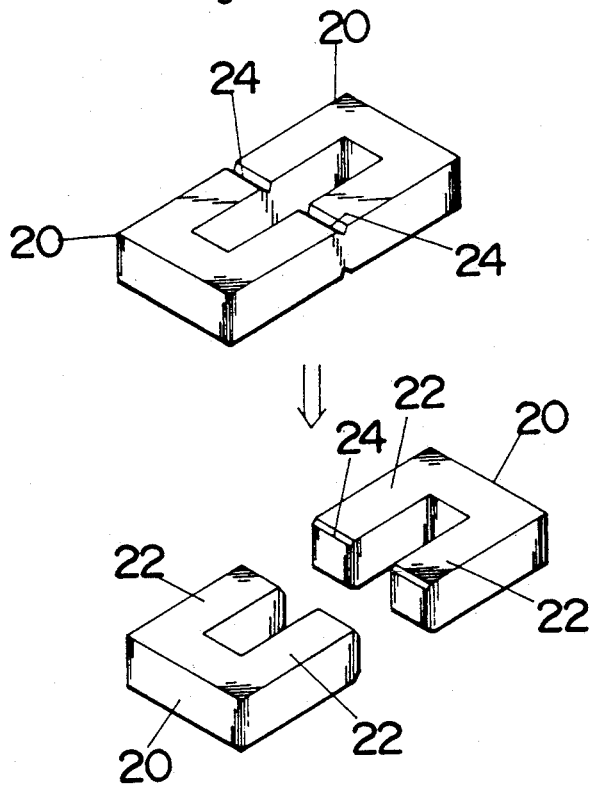
FIG. 11 is a schematic view illustrating the forming of single core from a sintered product.

As shown in FIG. 11, the U-shaped core 20 of the present embodiment is obtained as being cut from a sintered ferrite member in the form of a rectangular loop frame. Since the rectangular loop frame can be prepared with increased dimensional stability, the resulting U-shaped core can have a correspondingly stabilized open distance between the core legs 22 for increased reliability. In order to divide the rectangular loop frame into the U-shaped cores 20, notches 24 are formed in the center of respective side bars of the loop frame at the time of fabrication thereof and remain at the end of the core legs 22 as beveled edges such that, as shown in FIG. 2, the edge of the core leg 22 is contoured to approximate a half circumference of the end face of the straight core 25. With this result, the magnetic flux can flow relatively uniformly from the end of the straight core 25 to the adjacent core leg 22 of the U-shaped core 20, improving magnetic efficiency, in addition to the fact that the circular perimeter of the straight core 25 is advantageous in reducing the length or the resistance of the winding and correspondingly reduce the loss and heating.

What is claimed is:

1. An inductive device, comprising:

a U-shaped ferrite magnetic core having a base and a pair of opposed legs integrally extending from the opposite ends of said base;

a straight ferrite magnetic core having two ends;

holder means for holding said straight ferrite magnetic core between said pair of opposed legs such that air gaps exist between said two ends of said straight ferrite magnetic core and respective ones of said pair of opposed legs; said holder means comprising a coil bobbin having a bobbin wall bounding a hollow bobbin interior portion, said hollow bobbin interior portion being adapted for receiving said straight ferrite magnetic core, and at least two tabs extending radially inwardly from a lowermost end of said bobbin wall for supporting said straight ferrite magnetic core in spaced relationship from a lower one of said pair of opposed legs;

a winding surrounding said coil bobbin containing said straight core; and each of said pair of opposed legs having a generally flat surface portion which is adapted for facing engagement with respective ones of the ends of said straight ferrite magnetic core for forming said air gaps.

2. An inductive device as set forth in claim 1, wherein said straight core comprises a cylindrical body, and wherein said ends of said straight ferrite magnetic core comprise parallel opposed end faces.

3. An inductive device as set forth in claim 1, wherein one of said ends of said straight core is physically coupled to an adjacent one of said pair of opposed legs by an electrically insulating material, thereby constituting one of said air gaps.

4. An inductive device as set forth in claim 1, wherein said coil bobbin is composed of an electrically insulating material adapted to be disposed between said pair of opposed legs of said U-shaped core, and wherein said coil bobbin includes a cylindrical bore into which said straight core is received.

5. An inductive device as set forth in claim 4, wherein said holder means includes a pair of slots for receiving respective ones of said opposed pair of legs of said U-shaped core.

6. An inductive device as set forth in claim 4, wherein said holder means includes a plurality of terminal pins to which the ends of said winding are connected, and a pair of guide grooves are disposed on said coil bobbin for receiving the end portions of said winding, said guide grooves constituting a passage leading to said plurality of terminal pins.

7. An inductive device as set forth in claim 1 or 2, wherein each of said opposed pair of legs has its end portion configured to present a contoured edge which extends adjacent perimetric portions of respective ones of said ends of said straight core.

8. An inductive device as set forth in claim 3, further comprising elastic member disposed between the other one of said ends of said straight core and the corresponding one of said pair of opposed legs.

9. An inductive device as set forth in claim 1, wherein each of said airgaps is fitted with an elastic adhesive exhibiting large flexibility.

10. An inductive device as set forth in claim 5, wherein said straight core is adhered at one of its ends, which is physically coupled to the adjacent one of said pair of opposed legs, to said tabs; and wherein said U-shaped ferrite magnetic core is adhered to said holder means such that one of said pair of opposed core legs is pressed against a bottom wall of the corresponding one of said pair of slots in said holder means, while the other one of said pair of opposed legs is spaced away from a bottom wall of the other one of said pair of opposed slots.

11. An inductive device, comprising:

a U-shaped ferrite magnetic core having a base and a pair of opposed legs integrally extending from the opposite ends of said base;

a straight ferrite magnetic core having two ends;

holder means for holding said straight ferrite magnetic core between said pair of opposed legs such that air gaps exist between said two ends of said straight ferrite magnetic core and respective ones of said pair of opposed legs; said holder means comprising a coil bobbin having a slot for receiving each of the legs of said U-shaped ferrite magnetic core, the slot being bounded by a pair of sidewalls and an endwall supported by one of a pair of sheet-like flange members, in which said flange members are in spaced, parallel arrangement at opposite ends of a barrel, the barrel having a cylindrical shape for receiving a cylindrical core, the lower one of said pair of flange members including a passage formed form an upper surface thereof to a lower surface thereof and including a plurality of terminal pins on the lower surface thereof, in which windings disposed about said barrel have ends which are arranged in said passage and connected to corresponding ones of said terminal pins;

a winding surrounding said coil bobbin containing said straight core; and each of said pair of opposed legs having a generally flat surface portion which is adapted for facing engagement with respective ones of the ends of said straight ferrite magnetic core for forming said air gaps.

* * * * *